US006026901A

United States Patent [19]

Brady et al.

[11] Patent Number: 6,026,901

[45] Date of Patent: Feb. 22, 2000

[54] METHOD AND SYSTEM FOR SEPARATING AND INJECTING GAS IN A WELLBORE

[75] Inventors: Jerry L. Brady; Mark D. Stevenson; John M. Klein; James L. Cawvey, all of Anchorage, Ak.

[73] Assignee: Atlantic Richfield Company, Los Angeles, Calif.

[21] Appl. No.: 09/170,829

[22] Filed: Oct. 13, 1998

Related U.S. Application Data

[63] Continuation of application No. 09/088,499, Jun. 1, 1998, abandoned.

[51] Int. Cl.[7] ..... E21B 43/38

[52] U.S. Cl. ..... 166/265; 166/306; 166/105.5

[58] Field of Search ..... 166/265, 105, 166/105.5, 105.6, 169, 306, 369

[56] References Cited

U.S. PATENT DOCUMENTS

| | | | |
|---|---|---|---|
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

OTHER PUBLICATIONS

U.S. application No. 09/016,612, Brady et al., filed Jan. 30, 1998.

U.S. application No. 09/028,624, Stevenson et al., filed Feb. 24, 1998.

U.S. application No. 09/056,272, Brady et al., filed Apr. 7, 1998.

U.S. application No. 09/158,391, Brady et al., filed Sep. 22, 1998.

"New Design for Compact Liquid–Gas Partial Separation: Downhole and Surface Installations for Artificial Lift Applications" by J.S. Weingarten, M.M. Kolpak, S.A. Mattison and M.J. Williamson, 1995.

"Development and Testing of a Compact Liquid–Gas Auger Partial Separator for Downhole or Surface Applications" by J.S. Weingarten, M.M. Kolpak, S.A. Mattison and M.J. Williamson, 1997.

"Slim Phase 4™", Sperry–Sun Drilling Services, 1994, 1995.

"New Design Expands Success of Slim Phase 4™ MWD Resistivity Tool", Sperry Sun Drilling Services, Fall 1995.

"Improved Production Log Interpretation in Horizontal Wells Using Pulsed Neutron Logs", by J.L. Brady, J.J. Kohring and R.J. North, 1996.

"Glossary of Terms & Expressions Used in Well Logging", Society of Professional Well Log Analysis, Oct., 1984.

"Jet Pumping" by Hal Petrie, Undated.

*Primary Examiner*—David Bagnell
*Assistant Examiner*—Sunil Singh
*Attorney, Agent, or Firm*—F. Lindsey Scott

[57] ABSTRACT

A method and system for increasing oil production from an oil well producing a mixture of oil, water, gas, and/or solids through a wellbore penetrating an oil-bearing formation containing an oil-bearing zone and a selected injection zone, by separating from the mixture of oil, water, gas, and/or solids in the oil well at least a portion of the gas to produce a first separated gas and a first portion of an oil-enriched mixture; directing the first portion of the oil-enriched mixture through a bypass passageway having an outlet in fluid communication with a surface so that the first portion of the oil-enriched mixture bypasses a turbine in the oil well; driving the turbine with the first separated gas; driving a compressor in the oil well with the turbine; separating from the first separated gas in the oil well at least a portion of the gas to produce a second separated gas and a second portion of an oil-enriched mixture; compressing with the compressor the second separated gas to a pressure greater than a pressure in the selected injection zone to produce a compressed gas; injecting the compressed gas into the selected injection zone; and recovering at least a major portion of the first portion of the oil-enriched mixture and the second portion of the oil-enriched mixture.

10 Claims, 5 Drawing Sheets

METHOD AND SYSTEM FOR SEPARATING AND INJECTING GAS IN A WELLBORE

This is a continuation of application Ser. No. 9/088,499, filed Jun. 1, 1998, now abandoned.

FIELD OF THE INVENTION

This invention relates to a method and system for separating and injecting gas in a wellbore and, more particularly, to such a method and system for separating and injecting gas in a wellbore to increase the production of oil from oil wells producing a mixture of oil, water, gas, and/or solids through a wellbore penetrating an oil bearing formation containing an oil bearing zone and a selected injection zone.

BACKGROUND OF THE INVENTION

In many oil fields the oil bearing formation comprises a gas cap zone and an oil bearing zone. Many of these fields produce a mixture of oil and gas with the gas to oil ratio (GOR) increasing as the field ages. This is a result of many factors well known to those skilled in the art. Typically the mixture of gas and oil is separated into an oil portion and a gas portion at the surface. The gas portion may be marketed as a natural gas product, injected to maintain pressure in the gas cap or the like. Further, many such fields are located in parts of the world where it is difficult to economically move the gas to market therefore the injection of the gas preserves its availability as a resource in the future as well as maintaining pressure in the gas cap.

Wells in such fields may produce mixtures having a GOR of over 10,000 standard cubic feet per standard barrel (SCF/STB). In such instances, the mixture may be less than 1% liquids by volume in the well. Typically a GOR from 800 to 2,500 SCF/STB is more than sufficient to carry the oil to the surface as a gas/oil mixture. Normally the oil is dispersed as finely divided droplets or a mist in the gas so produced. In many such wells quantities of water may be recovered with the oil. The term "oil" as used herein refers to hydrocarbon liquids produced from a formation. The surface facilities for separating and returning the gas to the gas cap obviously must be of substantial capacity when such mixtures are produced to return sufficient gas to the gas cap or other depleted formations to maintain oil production.

Typically, in such fields, gathering lines gather the fluids into common lines which are then passed to production facilities or the like where crude oil, condensate, and other hydrocarbon liquids are separated and transported as crude oil. Natural gas liquids are then recovered from the gas stream and optionally combined with the crude oil and condensate. Optionally, a miscible solvent which comprises carbon dioxide, nitrogen and a mixture of light hydrocarbons such as contained in the gas stream may be used for enhanced oil recovery or the like. The remaining gas stream is then passed to a compressor where it is compressed for injection. The compressed gas is injected through injection wells, an annular section of a production well, or the like, into the gas cap.

Clearly the size of the surface equipment required to process the mixture of gas and oil is considerable and may become a limiting factor on the amount of oil which can be produced from the formation because of capacity limitations on the ability to handle the produced gas.

It has been disclosed in U.S. Pat. No. 5,431,228 "Down Hole Gas-Liquid Separator for Wells" issued Jul. 11, 1995 to Weingarten et al and assigned to Atlantic Richfield Company that an auger separator can be used downhole to separate a gas and liquid stream for separate recovery at the surface. A gaseous portion of the stream is recovered through an annular space in the well with the liquids being recovered through a production tubing.

In SPE 30637 "New Design for Compact Liquid-Gas Partial Separation: Down Hole and Surface Installations for Artificial Lift Applications" by Weingarten et al it is disclosed that auger separators as disclosed in U.S. Pat. No. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantity of oil which can be produced from a subterranean formation which produces oil as a mixture of gas and liquids.

A co-pending patent application, Ser. No. 09/028,624, entitled "Method and System for Separating and Injecting Gas in a Wellbore", filed Feb. 24, 1998, discloses driving a turbine with production fluids, separating gas from an oil-enriched mixture of oil and gas, compressing the gas with a compressor driven by the turbine, and injecting the gas back into the formation. While such a system relieves the load on surface processing equipment, the blades in the turbine are vulnerable to damage from solids and liquids produced in some formations and therefore may require periodic maintenance to cure such damage.

Accordingly, a continuing search has been directed to the development of systems which permit increased amounts of oil to be produced from subterranean formations which produce, in addition to oil and gas, liquids and/or solids which may damage turbine blades.

SUMMARY OF THE INVENTION

According to the present invention, it has been found that increased quantities of oil can be produced from an oil well producing a mixture of oil, water, gas, and/or solids through a wellbore penetrating an oil-bearing formation containing an oil-bearing zone and a selected injection zone, by separating from the mixture of oil, water, gas, and/or solids in the oil well at least a portion of the oil and gas to produce a separated gas/oil portion and a first portion of an oil-enriched mixture; directing the first portion of the oil-enriched mixture through a bypass passageway having an outlet in fluid communication with a surface so that the first portion of the oil-enriched mixture bypasses a turbine in the oil well; driving the turbine with the separated gas/oil portion; driving a compressor in the oil well with the turbine; separating from the separated gas/oil portion in the oil well at least a portion of the gas to produce a separated gas and a second portion of the oil-enriched mixture; compressing with the compressor the separated gas to a pressure greater than a pressure in the selected injection zone to produce a compressed gas; injecting the compressed gas into the selected injection zone; and recovering at least a major portion of the first portion of the oil-enriched mixture and the second portion of the oil-enriched mixture.

The present invention further comprises a system for increasing oil production from an oil well producing a mixture of oil, water, gas, and/or solids through a wellbore penetrating a formation containing an oil-bearing zone and a selected injection zone, wherein the system comprises a first separator positioned in the wellbore in fluid communication with the formation; a bypass passageway positioned in the wellbore, the bypass passageway having an inlet and an outlet, the inlet being in fluid communication with an oil-enriched mixture outlet from the first separator, and the outlet being in fluid communication with a surface; a turbine positioned in the wellbore, the turbine having an inlet in fluid communication with a gas outlet from the first separator; a second separator positioned in the wellbore, the second separator having an inlet in fluid communication with an outlet from the turbine, and having an oil-enriched mixture outlet in fluid communication with a surface; and a compressor positioned in the wellbore, drivingly connected to the turbine, and having an inlet in fluid communication with a gas outlet from the second separator, and a compressed gas discharge outlet in fluid communication with the selected injection zone.

An alternate embodiment of the present invention comprises a method for increasing oil production from an oil well producing a mixture of oil, water, gas, and/or solids through a wellbore penetrating an oil-bearing formation containing an oil-bearing zone and a selected injection zone, by separating from the mixture of oil, water, gas, and/or solids in the oil well at least a portion of the gas to produce a first separated gas and an oil-enriched mixture; separating from the oil-enriched mixture in the oil well at least a portion of the gas to produce a second separated gas; directing at least a portion of the oil-enriched mixture through a bypass passageway having an outlet in fluid communication with a surface so that the at least a portion of the oil-enriched mixture bypasses a turbine in the oil well; driving the turbine with the second separated gas; driving a compressor in the oil well with the turbine to compress the first separated gas to a pressure greater than a pressure in the selected injection zone to produce a compressed gas; injecting the compressed gas into the selected injection zone; and recovering at least a major portion of the oil-enriched mixture.

The alternate embodiment of the invention further comprises a system for increasing the production of oil from a production oil well producing a mixture of oil, water, gas, and/or solids through a wellbore penetrating a formation containing an oil-bearing zone and a selected injection zone, wherein the system comprises a separator positioned in the wellbore in fluid communication with the formation; a first bypass passageway positioned in the wellbore, the bypass passageway having an inlet in fluid communication with an oil-enriched mixture outlet from the separator, the first bypass passageway being configured for directing fluid flowing therethrough into a first flow direction and into a second flow direction; a second bypass passageway positioned in the wellbore, the second bypass passageway having an inlet in fluid communication with a first outlet from the first bypass passageway, the second bypass passageway inlet being substantially aligned with the first flow direction, the second bypass passageway having an oil-enriched mixture outlet in fluid communication with a surface; a turbine positioned in the wellbore, the turbine having an inlet in fluid communication with a second outlet from the first bypass passageway; and a compressor positioned in the wellbore, drivingly connected to the turbine, and having an inlet in fluid communication with a gas outlet from the separator, and a compressed gas discharge outlet in fluid communication with the selected injection zone.

DESCRIPTION OF THE PREFERRED EMBODIMENTS

In the discussion of the Figures, the same numbers will be used to refer to the same or similar components throughout. In the interest of conciseness, certain components of the wells necessary for the proper operation of the wells have not been discussed.

Figure 1:
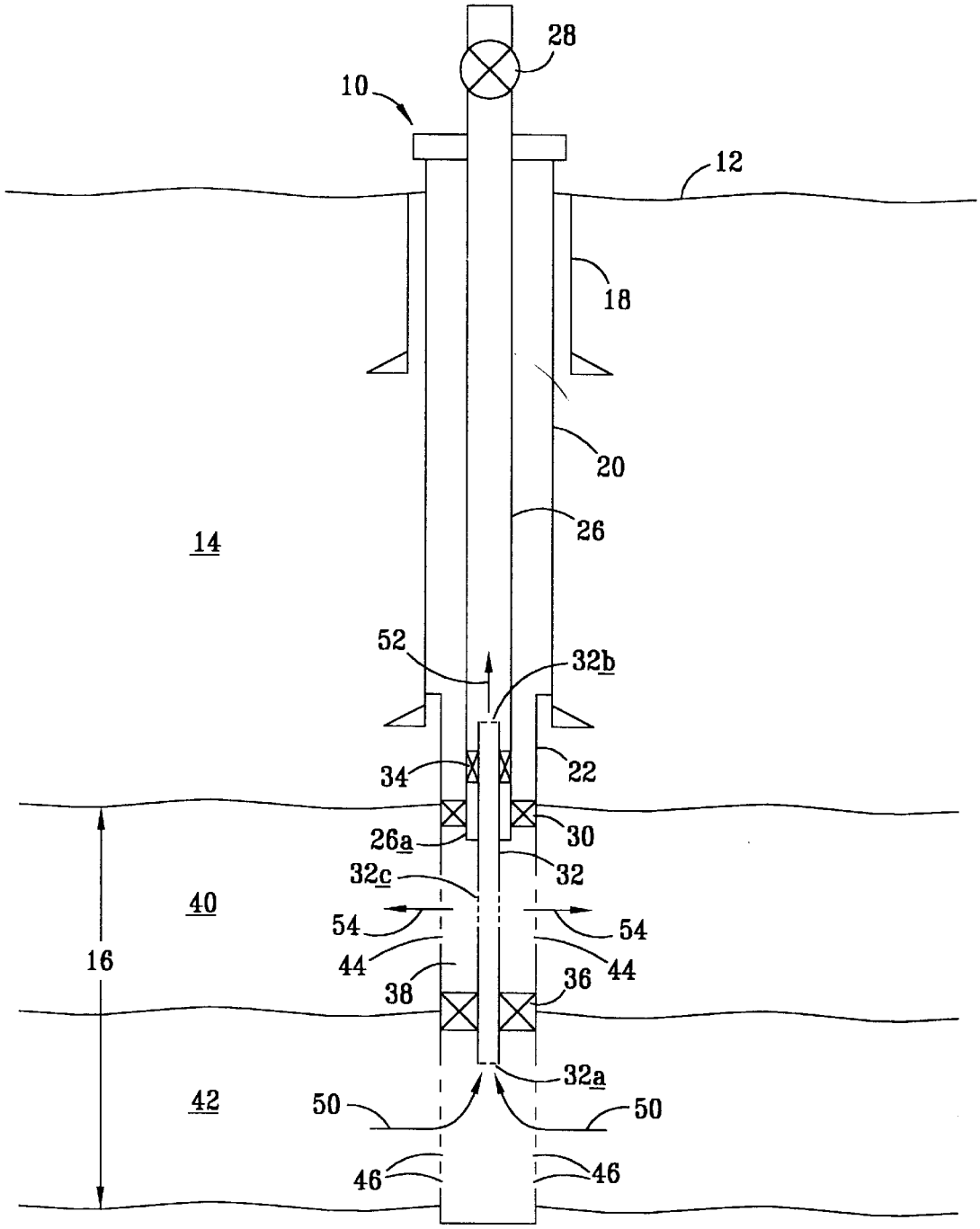
FIG. 1 is a schematic diagram of a production well configured for producing an oil-enriched mixture of oil, gas, water, and/or solids from a subterranean formation in accordance with the present invention.

In FIG. 1, a production oil well 10 is positioned in a wellbore (not shown) to extend from a surface 12 through an overburden 14 to an oil bearing formation 16. The production oil well 10 includes a first casing section 18, a second casing section 20, and a third casing section 22. The casings are of a decreasing size, and may include more or fewer than three casing sections. The use of such casing sections is well known to those skilled in the art for the completion of oil wells. While the production oil well 10 is shown as a well which extends vertically into the formation 16, it may alternatively be curved to extend at an angle into the formation, or include a section which extends horizontally into the formation. Such variations are well known to those skilled in the art for the production of oil from subterranean formations.

The oil well 10 also includes a tubing string referred to herein as production tubing 26 for the production of fluids from the well 10. The production tubing 26 extends downwardly from a wellhead 28, shown schematically as a valve, toward the formation 16. The wellhead 28 contains the necessary valving and the like to control the flow of fluids into and from the oil well 10, the production tubing 26, and the like. A packer 30 is positioned to prevent the flow of fluids in the annular space between the exterior of the production tubing 26 and the interior of casing sections 20 and 22 above the packer 30.

A tubular member 32 is positioned in a manner well known to those skilled in the art in a lower end 26a of the production tubing 26. The positioning of such tubular members by wire line or coiled tubing techniques is well known to those skilled in the art and will not be discussed. The tubular member 32 is secured in position with two packers 34 and 36, or nipples with locking mandrels, which are positioned to prevent the flow of fluids between the tubular member 32 and, respectively, the production tubing 26 and the third casing section 22. The tubular member 32 includes an inlet 32*a* for receiving a stream of fluids, and an upper outlet 32*b* and a lower outlet 32*c* for discharging streams of fluids. An annular space 38 is formed laterally between the tubular member 32 and the third casing section 22, and longitudinally between the packers 30 and 34 and the packer 36.

The formation 16 includes a selected injection zone 40 and an oil-bearing zone 42 underlying the injection zone 40. The selected injection zone 40 may be a gas cap zone, an aqueous zone, a portion of the oil-bearing zone 42, a depleted portion of the formation 16, or the like. While the oil-bearing zone 42 is shown in FIG. 1 as underlying the injection zone 40, the oil-bearing zone 42 may alternatively overlie the injection zone 40. Pressure in the formation 16 is maintained by gas in the injection zone 40 and, accordingly, it is desirable in such fields to maintain the pressure in the injection zone as hydrocarbon fluids are produced from the formation 16 by injecting gas into the injection zone. The formation pressure may be maintained by water injection, gas injection, or both. The injection of gas requires the removal of the liquids from the gas, compressing the gas, and injecting the gas back into the injection zone 40. Typically, the GOR of oil and gas mixtures recovered from formations, such as the oil bearing formation 16, increases as oil is removed from the formation.

The third casing section 22 is perforated with perforations 44 to provide fluid communication between the annular space 38 and the selected injection zone 40. The third casing section 22 is further perforated with perforations 46 for providing fluid communication between the interior of the third casing section 22 and the oil-bearing zone 42. The well 10, as shown, produces fluids under the formation pressure and does not require a pump. As will be described in further detail below, fluids may flow from the oil-bearing zone 42, as indicated schematically by arrows 50 into the inlet 32*a* of the tubular member 32. A portion of the fluids are discharged from the tubular member 32 upwardly through the outlet 32*b* into the production tubing 26, as indicated schematically by an arrow 52, and through the wellhead 28 to processing equipment (not shown) at the surface 12. A remaining portion of the fluids which enter the tubular member 32 through the inlet 32*a* are discharged outwardly through the outlet 32*c* into the selected injection zone 40, as indicated schematically by arrows 54. The apportioning of the flow of fluids between the outlets 32*b* and 32*c* is achieved in the interior of the tubular member 32 utilizing features of the present invention as will be described below with respect to FIGS. 2–4.

Figure 2:
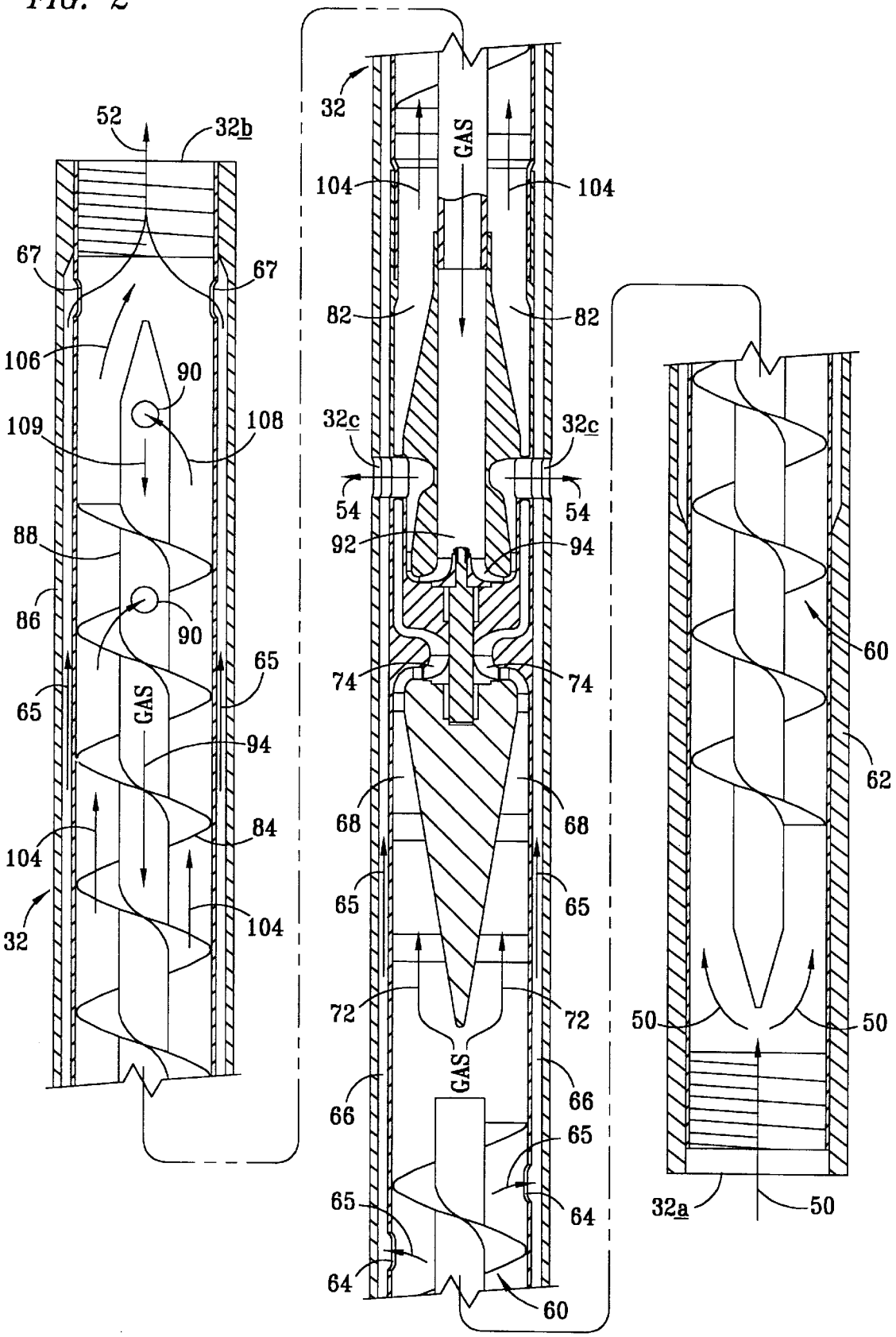
FIG. 2 is a schematic cross-section of an embodiment of an interior portion of a tubular member of the system of FIG. 1.

In FIG. 2, a cross-section of an interior embodiment of the tubular member 32 is schematically shown. As shown therein, a downhole separator 60 such as an auger separator (depicted in FIG. 2), a cyclone separator, a rotary centrifugal separator, or the like, is positioned in a lower portion 62 of the tubular member 32. Auger separators are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", Jean S. Weingarten et al, SPE 30637 presented Oct. 22–25, 1995, both of which references are hereby incorporated in their entirety by reference. Such separators are considered to be well known to those skilled in the art and are effective to separate at least a major portion of the gas from a flowing stream of liquids (e.g., oil and water), solids, and gas by causing the fluid mixture to flow around a circular path thereby forcing heavier phases, i.e., the liquids and/or solids, outwardly by centrifugal force through an outlet 64 and upwardly through an annular bypass passageway 66. The bypass passageway 66 is configured to carry fluids upwardly through the tubular member 32, as indicated by arrows 65, so that the fluids bypass the blades of a turbine described below. The bypass passageway 66 includes outlets 67 through which such fluids are discharged to the upper outlet 32*b* and upwardly into the production tubing 26 as described below. The lighter phases of the mixture, i.e., the gases, are displaced inwardly within the separator, away from the heavier phases. An inlet passageway 68 configured for receiving gas separated in the separator 60 is formed about a cone-shaped member 70 such that the passageway 68 narrows so that, as gas received from the separator 60 flows upwardly through it, as indicated by arrows 72, the velocity of the gas increases.

Figure 3:
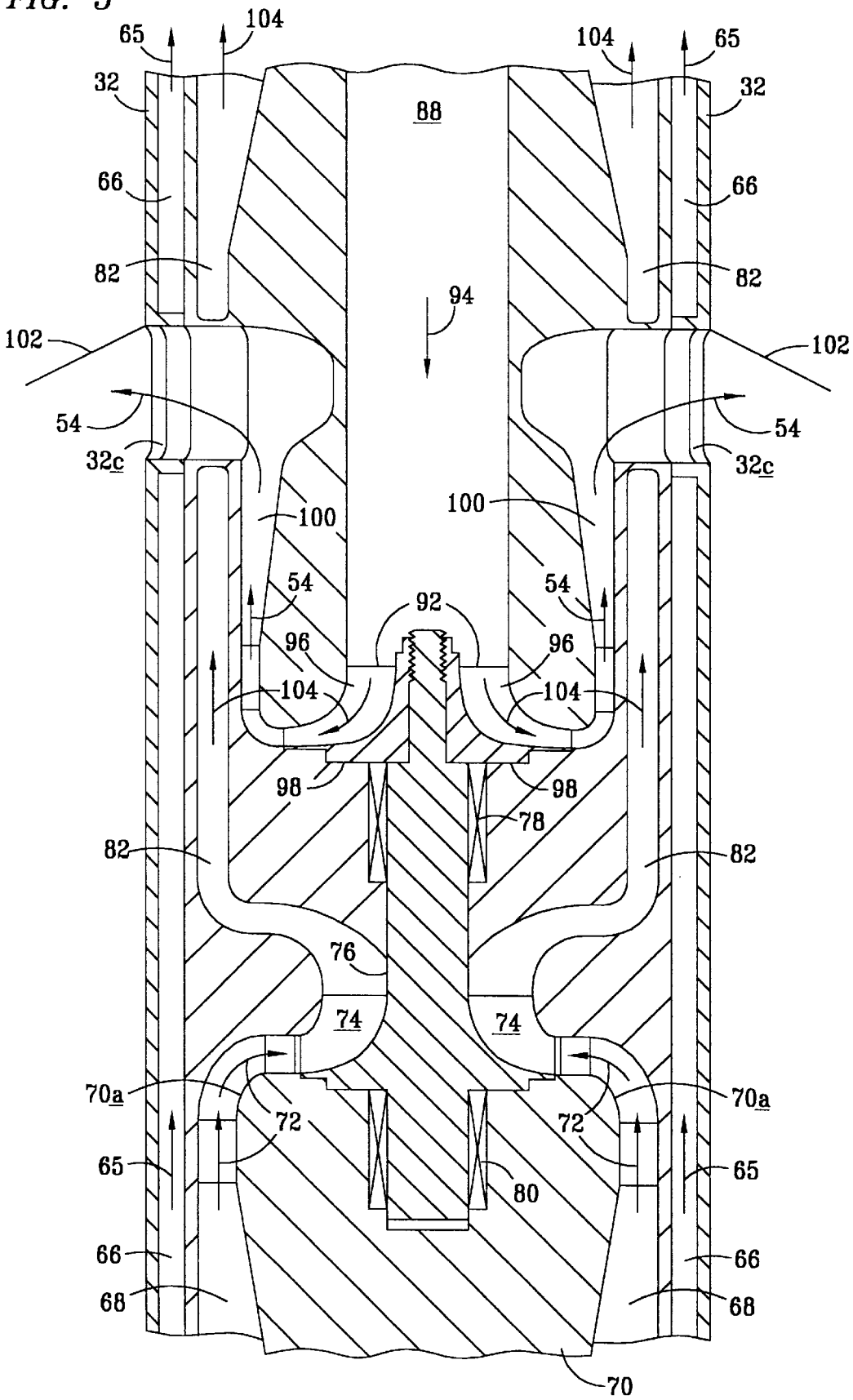
FIG. 3 is an enlargement of a portion of the embodiment of FIG. 2.

As shown schematically in FIG. 3 by the arrows 72, the inlet passageway 68 is configured to direct a stream of fluids received therein through a 90° change of direction around a shoulder 70*a* of the cone-shaped member 70 to enter radially into a plurality of suitable turbine impeller blades 74 (only two of which are shown) mounted to a shaft 76 to form a suitable turbine. The shaft 76 is rotatably mounted within the tubular member 32 on suitable upper and lower bearings 78 and 80, respectively, so that the shaft 76 may rotate when the impeller blades 74 are impinged with fluid received from the passageway 68. While the turbine comprising the blades 74 and the shaft 76 is depicted in FIG. 3 as a radial turbine, any of a number of different types of radial or axial turbines, such as a turbine expander, a hydraulic turbine, a bi-phase turbine, or the like, may be utilized in the present invention. Turbine expanders, hydraulic turbines, and bi-phase turbines are considered to be well known to those skilled in the art, and are effective for receiving a stream of fluids and generating, from the received stream of fluids, torque exerted onto a shaft, such stream of fluids comprising largely gases, liquids, and mixtures of gases and liquids, respectively. Bi-phase turbines, in particular, are more fully disclosed and discussed in U.S. Pat. No. 5,385,446, entitled "Hybrid Two-Phase Turbine", issued Jan. 31, 1995, to Lance G. Hays, which reference is hereby incorporated in its entirety by reference.

As shown in FIG. 2, a passageway 82 is configured for carrying fluids discharged from the turbine blades 74 to an upper separator 84 positioned in an upper portion 86 of the tubular member 32. The separator 84 is depicted in FIG. 2 as an auger separator, but, like the separator 60, it may comprise a cyclone separator, a rotary centrifugal separator, or the like, effective for separating heavier phases of fluids from lighter phases. The separator 84 includes a central return tube 88 having one or more gas inlets 90 (two of which are shown) for receiving lighter phases, comprising substantially gases, separated from heavier fluids, comprising substantially an oil enriched mixture of oil, water, gas, and/or solids. The central return tube 88 is hollow and sealed at the top and is thus effective for constraining the flow of separated gases received through the inlets 90 to a downwardly direction toward a gas outlet 92 of the central return tube 88, described more fully below with respect to FIG. 3.

As further shown in FIG. 3, the central return tube 88 is configured to direct a stream of separated gas received therein downwardly through the gas outlet 92, as indicated schematically by an arrow 94, to a plurality of suitable compressor impeller blades 96 (only two of which are shown) secured to a rotor 98 fixed to the turbine shaft 76. The blades 96 secured to the rotor 98 form a gas compressor driven by the turbine shaft 76. While the gas compressor is depicted as a radial compressor, it may be any suitable compressor, such as an axial, radial, or mixed flow compressor, or the like, drivingly connected to the turbine shaft 76. An annular diffuser passageway 100 (or alternatively a plurality of discrete diffuser passageways 100) is configured for carrying compressed gas from the compressor blades 96 to the plurality of discharge outlets 32*c* (only two of which are shown), as shown schematically by arrows 54, and for diffusing the gas so that the pressure of the gas is increased as it is discharged through the discharge outlets 32*c*. Check valves 102 are optionally positioned over the discharge outlets 32*c* to prevent fluids from flowing from the formation 16 (not shown in FIG. 3) into the compressor impeller blades 96.

In the operation of the system shown in FIGS. 1–3, a mixture of oil, water, gas, and/or solids flows, as indicated schematically by the arrows 50 in FIG. 1, from the oil-bearing zone 42, through the perforations 46, and through the inlet 32*a* of the tubular member 32. As further shown in FIG. 2, the mixture flows through the inlet 32*a* to the separator 60. The separator 60 separates heavier phases, comprising substantially oil and water, from lighter phases, comprising substantially oil and gas, thereby producing a first oil-enriched mixture and a separated gas/oil portion. The first oil-enriched mixture flows through the outlet 64 into and upwardly through the annular bypass passageway 66, as indicated by the arrows 65, through the openings 67 into the production tubing 26 (FIG. 1), as indicated by the arrows 52, and through the wellhead 28 (FIG. 1) to downstream processing facilities (not shown). The separated gas/oil portion flows to and through the inlet passageway 68.

As shown in the FIG. 3, the separated gas/oil portion flows through the inlet passageway 68 and around the cone-shaped member 70. The passageway 68 narrows as the gas/oil portion flows through it and, as a result, the velocity of the gas/oil portion increases until it impinges the turbine impeller blades 74. As the gas/oil portion impinges the turbine impeller blades 74, rotational motion is imparted to the turbine impeller blades 74, the shaft 76, the rotor 98, and the compressor impeller blades 96. Consequently, as the gas/oil portion flows through the turbine impeller blades 74, the pressure and temperature of the gas/oil portion decreases, thereby facilitating the separation in the upper separator 84, discussed below, of additional quantities of liquids from the fluids. As indicated schematically by arrows 104, the gas/oil portion then flows from the impeller blades 74 upwardly through the passageway 82 to and through the upper separator 84 (FIG. 2).

Referring to FIG. 2, as the gas/oil portion flows through the upper separator 84, it flows in a circular path thereby forcing the heavier phases of the gas/oil portion outwardly by centrifugal force to produce a second oil-enriched mixture. The second oil-enriched mixture flows upwardly past the inlets 90, as shown schematically by an arrow 106, and into the production tubing 26 where it combines with the first oil-enriched mixture to form an oil-enriched mixture which flows to the surface 12 and is recovered through the well head 28 and passed to further gas/liquid separation and the like (not shown). Gas recovered from the produced oil-enriched mixture may then be injected through an injection well, produced as a gas product, or the like.

The heavier phases of the oil/gas portion which, in the upper separator 84, are forced outwardly by centrifugal force, displace the lighter phases, comprising substantially gas, inwardly toward the central return tube 88. The inwardly displaced gas is recovered through the gas inlet 90 of the central return tube 88, as shown schematically by an arrow 108, and is passed downwardly, as shown schematically by the arrow 94, through the tube 88.

Referring to FIG. 3, separated gas in the central return tube 88 passes through the gas outlet 92 to the plurality of compressor impeller blades 96. As the separated gas flows through the compressor impeller blades 96, the turbine shaft 76 drives the rotor 98 and the blades 96 to compress the gas. The compressed gas then enters the passageway 100 and is diffused as it moves toward the discharge outlets 32*c* and through the check valves 102, as shown schematically by the arrows 54, thereby further increasing the pressure of the gas until the pressure of the gas exceeds the pressure of the gas in the selected injection zone 40. As shown schematically in FIG. 1 by the arrow 54, the gas passes through the discharge outlet 32*c* into the annular space 38, through the perforations 44, and into the selected injection zone 40 of the formation 16.

The embodiment of FIGS. 1–3 may be configured and modified in a number of different ways which would be obvious and desirable to those skilled in the art based upon a review of the foregoing description. For example, the embodiment of FIGS. 1–3 may be configured so that the turbine blades 74 are driven by the second oil-enriched mixture flowing from the upper separator 84, identified schematically by the arrow 106 (FIG. 2), rather than by the gas/oil portion as shown in FIG. 2. The separators 60 and 84, turbine blades 74, and the compressor blades 96 may also arranged in a variety of configurations. For example, the turbine blades 74 and the compressor blades 96 may be positioned above the upper separator 84.

Figure 3A:
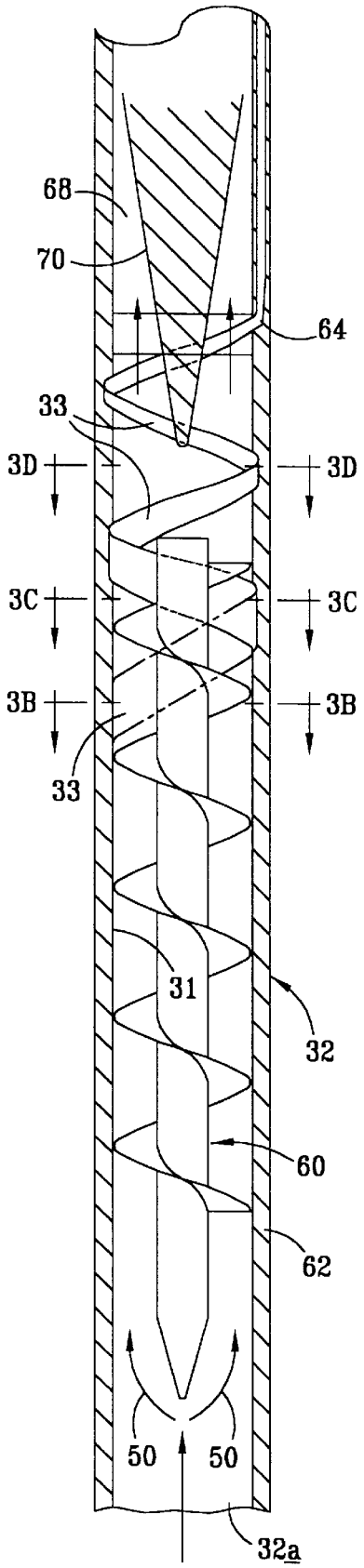
FIG. 3A shows a portion of an alternate embodiment of the embodiment shown in FIG. 2.
Figure 3B:
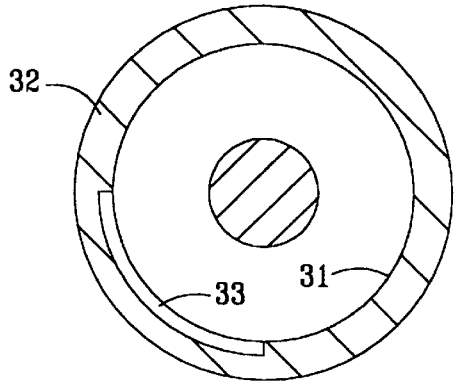
FIGS. 3B–3D show cross-sectional views of the embodiment of FIG. 3A taken along the lines 3B—3B, 3C—3C, and 3D—3D, respectively, of FIG. 3A.
Figure 3C:
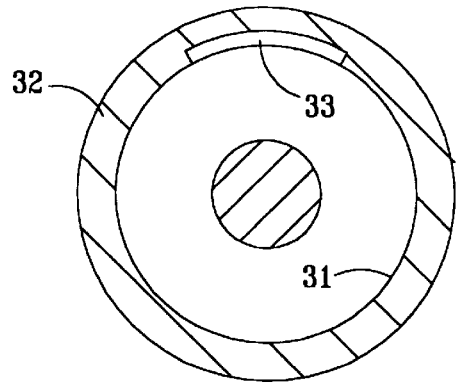
Figure 3D:
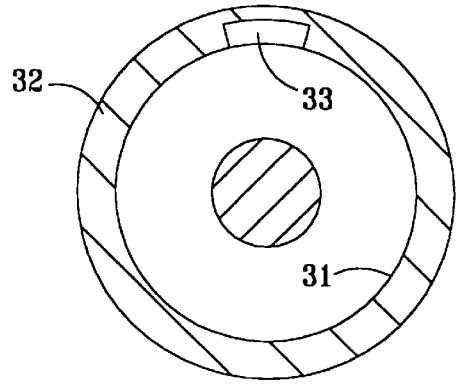

FIGS. 3A–3D illustrate a portion of an alternate embodiment of the system shown in FIGS. 1–3, in which an inside wall surface 31 of the tubular member 32 is provided with grooves 33 which spiral upwardly and terminate at the outlet 64, which outlet is positioned above the separator as viewed in FIG. 3A. As shown in cross-sectional views of FIGS. 3B–3D, the grooves 33 narrow circumferentially and deepen radially as they spiral upwardly for collecting heavier phases separated by the separator 64 and channeling the collected heavier phases into the outlet 64. Operation of the alternate embodiment shown in FIGS. 3B–3D is otherwise substantially similar to the operation of the embodiment shown in FIGS. 1–3.

Figure 4:
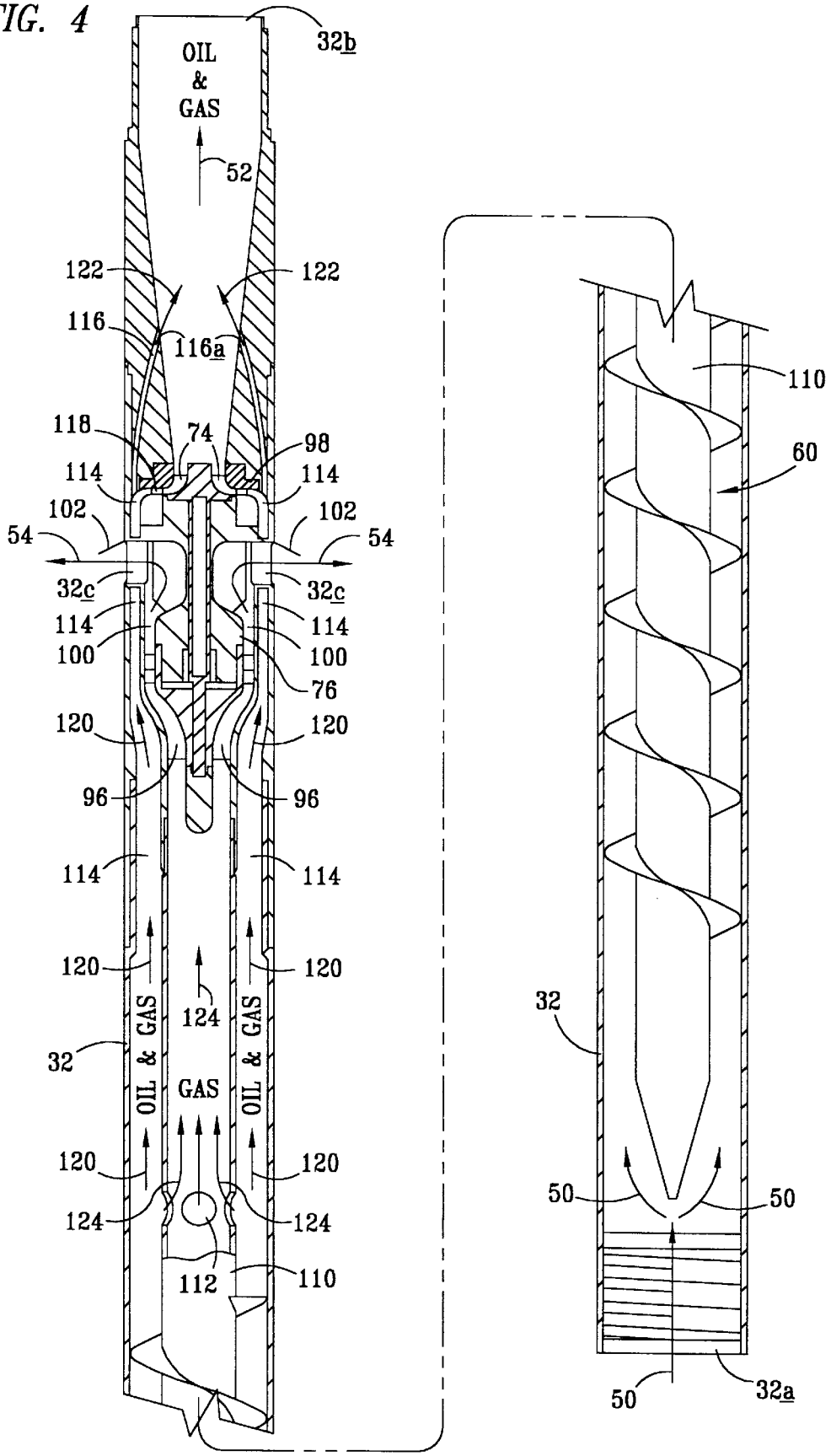
FIG. 4 is a schematic cross-section of an alternate embodiment of an interior portion of a tubular member of the system of FIG. 1.

FIG. 4 shows a cross-section of an alternate embodiment of the interior of the tubular member 32. As shown therein, the downhole separator 60 includes a hollow central flow tube 110 having at least one gas inlet 112 for receiving gas into the interior of the central flow tube 110, as described below. The separator 60 is effective to separate at least a major portion of the gas from a flowing stream comprising substantially oil, water, gas, and/or solids by causing the stream to flow around a circular path thereby forcing heavier phases outwardly by centrifugal force and upwardly as a first oil-enriched mixture through a first annular bypass passageway 114. The first (compressor) bypass passageway 114 is configured to carry the oil-enriched mixture through the tubular member 32, bypassing the compressor blades 96, to a second (turbine) bypass passageway 116 and a turbine inlet passageway 118. The second bypass passageway 116 is substantially aligned with the vertical direction of flow of the first oil-enriched mixture in the first bypass passageway 114 and includes an outlet 116*a* for discharging a second oil-enriched mixture into the production tubing 26 so that such mixture bypasses the turbine impeller blades 74. The passageway 118 is configured to direct a stream comprising substantially gas received from the annular passageway 114 through a 90° change of direction to enter radially into the plurality of turbine impeller blades 74 (only two of which are shown) mounted to the shaft 76. The shaft 76 is rotatably mounted within the tubular member 32 for imparting rotational motion to the rotor 98 and the compressor blades 96.

The central flow tube 110 is configured for carrying the separated gas received through the gas inlets 112 to the plurality of compressor impeller blades 96 (only two of which are shown) secured to the rotor 98. The annular diffuser passageway 100 (or alternatively a plurality of discrete diffuser passageways 100) is configured for carrying compressed gas from the compressor blades 96 to the discharge outlets 32*c*, as shown schematically by the arrows 54, and for diffusing the gas so that the pressure of the gas is increased as it is discharged through the discharge outlets 32*c*. The check valves 102 are optionally positioned over the discharge outlets 32*c* to prevent fluids from flowing from the formation 16 (FIG. 1) into the compressor blades 96.

In the operation of the system shown in FIG. 4, a mixture of oil, water, gas, and/or solids flows, as indicated schematically by the arrows 50 in FIG. 1, from the oil-bearing zone 42, through the perforations 46, and through the inlet 32*a* of the tubular member 32. As further shown in FIG. 4, fluids pass through the inlet 32*a* to the separator 60. The separator 60 separates heavier phases, comprising substantially oil and water, from lighter phases, comprising substantially gas, thereby producing a first oil-enriched mixture and a first separated gas. The first oil-enriched mixture flows upwardly through the first bypass passageway 114, as indicated schematically by the arrows 120. The heavier phases of the first oil-enriched mixture flow continue flowing upwardly through the second bypass passageway 116 and through the outlet 116*a*, as indicated schematically by arrows 122, and through the outlet 32*b* into the production tubing 26 (FIG. 1), as indicated schematically by the arrows 52, and through the wellhead 28 (FIG. 1) to downstream processing facilities (not shown). The lighter phases of the first oil-enriched mixture, comprising substantially a second separated gas, are displaced by the heavier phases and flow through a 90° change of direction to enter radially into the plurality of turbine impeller blades 74 (only two of which are shown). As the second separated gas flows through the turbine blades 74, rotational motion is imparted to the turbine blades, the shaft 76, the rotor 98, and the compressor blades 96. Gas is discharged from the turbine blades 74 upwardly through the outlet 32*b* and is recombined with the second oil-enriched mixture to form an oil-enriched mixture which flows to the surface 12 and is recovered through the well head 28 and passed to further gas/liquid separation and the like (not shown). Gas recovered from the produced oil-enriched mixture may then be injected through an injection well, produced as a gas product, or the like.

As indicated schematically by arrows 124, the separated gas produced by the separator 60 flows into the inlet 112 and upwardly through the central flow tube 110 to the compressor impeller blades 96. As the separated gas flows through the compressor impeller blades 96, the turbine shaft 76 drives the rotor 98 and the blades 96 to compress the gas. The compressed gas then enters the passageway 100 and is diffused as it moves toward the discharge outlets 32*c* and through the check valves 102, as shown schematically by the arrows 54, thereby further increasing the pressure of the gas until the pressure of the gas exceeds the pressure of the gas in the selected injection zone 40. As shown schematically in FIG. 1 by an arrow 54, the gas passes through the discharge outlet 32*c* into the annular space 38, through the perforations 44, and into the selected injection zone 40 of the formation 16.

By the use of the systems shown in FIGS. 1–4, liquids and solids which may damage the blades of a downhole turbine are separated from a stream of production fluids and are directed through at least one bypass passageway so that they do not damage the blades of the turbine. The turbine is driven substantially by gases separated from the produced fluids and, therefore, requires less maintenance than would be required if the damaging fluids were not directed to bypass the turbine.

Furthermore, a portion of the gas is removed from the oil/gas mixture and injected downhole without the necessity for passing the separated portion of the gas to the surface for treatment. This removal of a significant portion of the gas downhole relieves the load on surface equipment since a smaller volume of gas is produced to the surface. In many fields, GOR values as high as 25,000 SCF/STB are encountered. GOR values from 1,000 to 4,000 SCF/STB are generally more than sufficient to carry the produced liquids to the surface. A significant amount of the gas can thus be removed and injected downhole with no detriment to the production process. This significantly increases the amount of oil which can be recovered from formations which produce gas and oil in mixture which are limited by the amount of gas handling capacity available at the surface.

Still further, by the use of the method and device of the embodiment of the present invention shown in FIGS. 1–3, the entire mixture of oil, water, gas, and/or solids that flows from the formation 16 through the inlet 32*a* into the tubular member 32 is used to drive the turbine blades 74 to provide power for the gas compressor blades 96. As the entire mixture passes through the turbine, the temperature and pressure of the entire mixture is also reduced. As a result, additional hydrocarbon components of the mixture of oil and gas are condensed for separation in the separator 84 and can be recovered at the surface 12 as liquids.

The investment to install the system of the present invention in a plurality of wells to reduce the gas produced from a field is substantially less than the cost of providing additional separation and compression equipment at the surface. It also requires no fuel gas to drive the compression equipment since the pressure of the flowing fluids can be used for this purpose. It also permits the injection of selected quantities of gas from individual wells into a downhole gas cap, from which well oil production had become limited by reason of the capacity of the lines to carry produced fluids away from the well or processing equipment, thereby permitting increased production from such wells. It can also make certain formations, which had previously been uneconomical to produce from, economical to produce from because of the ability to inject the gas downhole.

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for increasing oil production from an oil well producing a mixture of oil, water, gas, and/or solids through a wellbore penetrating an oil-bearing formation containing an oil-bearing zone and a selected injection zone, the method comprising:

a) separating from the mixture of oil, water, gas, and/or solids in the oil well at least a portion of the oil and gas to produce a separated gas/oil portion and a first portion of an oil-enriched mixture;

b) directing the first portion of the oil-enriched mixture through a bypass passageway having an outlet in fluid communication with a surface so that the first portion of the oil-enriched mixture bypasses a turbine in the oil well;

c) driving the turbine with the separated gas/oil portion;

d) driving a compressor in the oil well with the turbine;

e) separating from the separated gas/oil portion in the oil well at least a portion of the gas to produce a separated gas and a second portion of the oil-enriched mixture;

f) compressing with the compressor the separated gas to a pressure greater than a pressure in the selected injection zone to produce a compressed gas;

g) injecting the compressed gas into the selected injection zone; and h) recovering at least a major portion of the first portion of the oil-enriched mixture and the second portion of the oil-enriched mixture.

2. The method of claim 1 wherein the steps of separating, driving, and compressing are performed in a tubular member in fluid communication with the formation and with the surface.

3. The method of claim 1 wherein the selected injection zone is selected from one of a gas cap zone, an aqueous zone, the oil bearing zone, and a depleted portion of the formation.

4. The method of claim 1 wherein the step of separating from the mixture of oil, water, gas, and/or solids is performed using a separator selected from a group of separators consisting of an auger separator, a cyclone separator, and a rotary centrifugal separator; and the step of separating from the separated gas/oil portion is performed using a separator selected from a group of separators consisting of an auger separator, a cyclone separator, and a rotary centrifugal separator.

5. A system for increasing the production of oil from a production oil well producing a mixture of oil, water, gas, and/or solids through a wellbore penetrating a formation containing an oil-bearing zone and a selected injection zone, the system comprising:

a) a first separator positioned in the wellbore in fluid communication with the formation;

b) a bypass passageway positioned in the wellbore, the bypass passageway having an inlet and an outlet, the inlet being in fluid communication with a first oil-enriched mixture outlet from the first separator, and the outlet being in fluid communication with a surface;

c) a turbine positioned in the wellbore, the turbine having an inlet in fluid communication with a gas outlet from the first separator;

d) a second separator positioned in the wellbore, the second separator having an inlet in fluid communication with an outlet from the turbine, and having a second oil-enriched mixture outlet in fluid communication with the surface; and e) a compressor positioned in the wellbore, drivingly connected to the turbine, and having an inlet in fluid communication with a gas outlet from the second separator, and a compressed gas discharge outlet in fluid communication with the selected injection zone.

6. The system of claim 5 further comprising a discharge passageway in fluid communication with the discharge outlet from the compressor and in fluid communication with the selected injection zone.

7. The system of claim 5 further comprising a discharge passageway in fluid communication with the discharge outlet from the compressor and in fluid communication with the selected injection zone, wherein the discharge passageway comprises a check valve positioned therein to prevent the flow of fluids from the formation into the compressor through the discharge passageway.

8. The system of claim 5 wherein the turbine, the first separator, the second separator, the compressor, and the bypass passageway are positioned in a tubular member positioned in the wellbore.

9. The system of claim 5 wherein the turbine, the first separator, the second separator, the compressor, and the bypass passageway are positioned in a tubular member positioned in a tubing string extending to the surface.

10. The system of claim 5 wherein the turbine, the first separator, the second separator, the compressor, and the bypass passageway are positioned in a tubular member positioned in the wellbore, wherein the tubular member has an interior wall surface with grooves formed therein which narrow and spiral upwardly for channeling the flow of the first oil-enriched mixture into the inlet of the bypass passageway.

* * * * *